United States Patent [19]

Pfizenmaier

[11] 4,050,380

[45] Sept. 27, 1977

[54] INK FOUNTAIN FOR PRINTING MACHINE

[75] Inventor: Wolfgang Pfizenmaier, Seeheim, Bergstr., Germany

[73] Assignee: Heidelberger Druckmaschinen Aktiengesellschaft, Heidelberg, Germany

[21] Appl. No.: 671,112

[22] Filed: Mar. 29, 1976

[30] Foreign Application Priority Data

Apr. 3, 1975 Germany ..... 2514509

[51] Int. Cl.[2] ..... B41F 31/04

[52] U.S. Cl. ..... 101/365

[58] Field of Search ..... 101/350, 363, 364, 365, 101/157, 169, 207, 208

[56] References Cited

U.S. PATENT DOCUMENTS

| | | | |
|---|---|---|---|
| 220,547 | 10/1879 | Prouty | 101/364 |
| 225,964 | 3/1880 | Bennett | 101/365 |
| 1,801,935 | 4/1931 | Pfister | 101/365 X |
| 1,825,999 | 10/1931 | Fankboner | 101/365 |
| 2,837,024 | 6/1958 | Dougan | 101/365 |
| 3,134,325 | 5/1964 | Worthington et al. | 101/365 |
| 3,176,611 | 4/1965 | Tripp | 101/364 |
| 3,294,060 | 12/1966 | McIntyre et al. | 101/169 |
| 3,456,585 | 7/1969 | Brodie | 101/365 |
| 3,800,702 | 4/1974 | Roberts | 101/365 |
| 3,815,499 | 6/1974 | Abler | 101/157 |

FOREIGN PATENT DOCUMENTS

| | | | |
|---|---|---|---|
| 739,054 | 10/1955 | United Kingdom | 101/364 |
| 129,396 | 10/1959 | U.S.S.R. | 101/364 |

*Primary Examiner*—J. Reed Fisher
*Attorney, Agent, or Firm*—Herbert L. Lerner

[57] ABSTRACT

Ink fountain for printing machines includes an elongated ink knife forming the base of the fountain, a fountain roller forming a side of the fountain, and means for zonewise adjusting the thickness of a film of ink on the fountain roller, the ink knife having a wiper edge adjacent the fountain roller for wiping ink therefrom, and being bent along the length thereof in direction toward the fountain roller at a location in vicinity of the wiper edge, the bent portion of the ink knife adjacent the wiper edge having an end face opposite to the fountain roller and adjustable in the spacing thereof relative to the fountain roller, the space defined by the bent ink knife and the fountain roller having a defining streamlined surface facilitating a return flow of the ink wiped from the fountain roller.

10 Claims, 2 Drawing Figures

INK FOUNTAIN FOR PRINTING MACHINE

Figure 1:
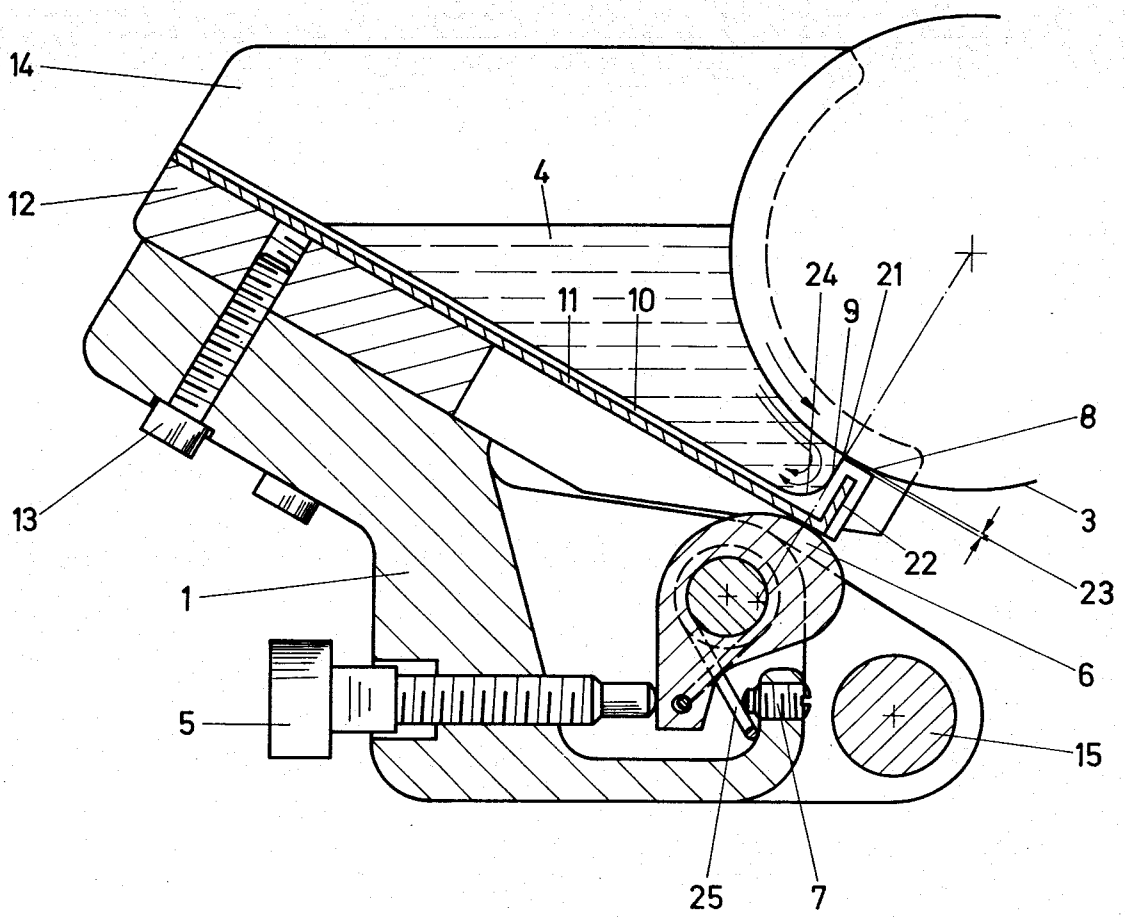

The invention relates to an ink fountain for printing machines and, more particularly, to such an ink fountain provided with an ink knife forming the base of the fountain and adjusting means for adjusting the ink film thickness zonewise relative to an ink ductor roller or fountain roller.

Ink fountains of this general type have become known heretofore from German Petty Patent DT-GM 1 707 927 wherein an ink knife is provided which lies in engagement with a fountain roller in the lower region of the fountain. Through rotary motion of the fountain roller, ink accumulation in the acute angle formed between the ink knife and the fountain roller and the hydrodynamic forces produced thereby act upon the ink knife. These forces are not uniform and vary, for example, with changes in the rotary speed of the fountain roller, changes in the temperature of the ink, and the like. Variation in the accumulation of ink has the effect of varying the adjusted ink film thickness on the fountain roller during the operation or running of the machine so that readjustment is necessary.

In the aforementioned heretofore known device of the German petty patent, the danger arises that ink residues and impurities or dirt will deposit within the acute angle formed between the ink knife and the fountain roller, and will also have a detrimental effect upon the constancy of the ink adjustmment. The deposited particles of impurities must be removed by swinging out and cleaning the ink fountain.

An ink fountain that has been known heretofore from German Published Prosecuted Application DT-AS 2 064 639 has set screws which act directly upon the wiper or scraper edge of the ink knife so that the varying hydrodynamic forces cannot have any effect upon the adjustment of the ink knife. Firm adjustment of the ink knife has the disadvantage, however, that the surface of the fountain roller may be damaged if the wiper edge is applied too hard. The risk also arises that particles of dirt or other impurities will deposit on the wiper edge and, after subsequent loosening thereof, can get between the fountain roller and the wiper edge and also damage the roller surface.

It is accordingly and object of the invention to provide an ink fountain for printing machines with an ink knife, the fountain together with the knife being so constructed that differences in the incident hydrodynamic forces cannot cause a variation in the ink knife adjustment, that the deposition of dirt or impurity particles where they may disturb the running of the machine is avoided, and that the flow characteristics of the ink in the ink fountain is improved.

With the foregoing and other objects in view, there is provided, in accordance with the invention an ink fountain for printing machines comprising an elongated ink knife forming the base of the fountain, a fountain roller forming a side of the fountain, and means for zonewise adjusting the thickness of a film of ink on the fountain roller, the ink knife having a wiper edge adjacent the fountain roller for wiping ink therefrom, and being bent along the length thereof in direction toward the fountain roller at a location in vicinity of the wiper edge, the bent portion of the ink knife adjacent the wiper edge having an end face opposite to the fountain roller and adjustable in the spacing thereof relative to the fountain roller, the space defined by the bent ink knife and the fountain roller having a defining streamlined surface facilitating a return flow of the ink wiped from the fountain roller.

Harmful depositions are thereby avoided, and the ink flow in the vicinity of the wiper edge is markedly improved. Also, an advantageous stirring action is provided in the ink of the ink fountain due to the purposeful removal of the wiped-off ink. Furthermore, the ink fountain can be cleaned very readily because no corners are present therein in which ink residues can deposit.

A conventional type of ink fountain heretofore known from German Published Prosecuted Application DT-AS 2 230 126 employs an ink knife displaceable in direction toward the ductor or fountain roller. The slide guides and the seals required thereat may become clogged after a relatively short time and thereby no longer afford sensitive adjustment.

In accordance with another feature of the invention, the bend in the ink knife is a substantially 90° -bend, and the bent portion of the ink knife has a wiper surface located adjacent the wiper edge and extending substantially at right angles to the fountain roller. If the forces acting upon the tip of the ink knife should vary, yielding or bending of the tip of the ink knife can have virtually no effect upon the adjustment of the ink knife relative to the fountain roller. Also, the stripped or wiped-off excess ink in the space formed by the bend can flow back easily into the ink fountain so that no particles of dirt or impurities are deposited. The disposition of the wiper surface at right angles to the fountain roller, in accordance with this feature of the invention, is ordinarily sufficient to effect an orderly, non-turbulent return flow into the ink fountain of the ink wiped off the wiper edge, for all types of inks that are used.

In accordance with a further feature of the invention, the ink fountain includes means for supporting the ink knife in direct vicinity of the bend formed therein. The greatest possible rigidity of the bent portion of the ink knife is thereby attained.

In accordance with an additional feature of the invention, the end face of the bent portion forms an acute angle with the wiper surface, in order to achieve advantageous flow characteristics with viscous printing inks. This advantageous achievement is further abetted by the fact that, in accordance with an added feature of the invention, the wiper surface, at a side thereof opposite the wiper edge, merges with a concave channel located at the bend in the ink knife.

In accordance with yet another feature of the invention, the ink knife is formed of elastic material and has a reinforcement formed of spring steel. Further in accordance with the invention, the reinforcement is subdivided into separate zones along the length of the knife so that sensitive or delicate zonewise regulation of ink quantity is assured.

In accordance with yet a further feature of the invention, the ink fountain includes cam lever means for supporting the ink knife in vicinity of the bend therein, the cam lever means being adjustable for varying zonewise the spacing between the fountain roller and the end face of the bent ink knife portion, set screw means for adjusting the cam lever means, and stop means for limited maximal adjustment of the set screw means.

In accordance with another feature of the invention, the ink fountain includes adjusting means, preferably adjusting screws, for adjusting the position of the ink knife relative to the fountain roller. The ink knife can thereby be adjusted as a whole relative to the fountain roller without varying the zonewise adjustment.

Other features which are considered as characteristic for the invention are set forth in the appended claims.

Figure 2:
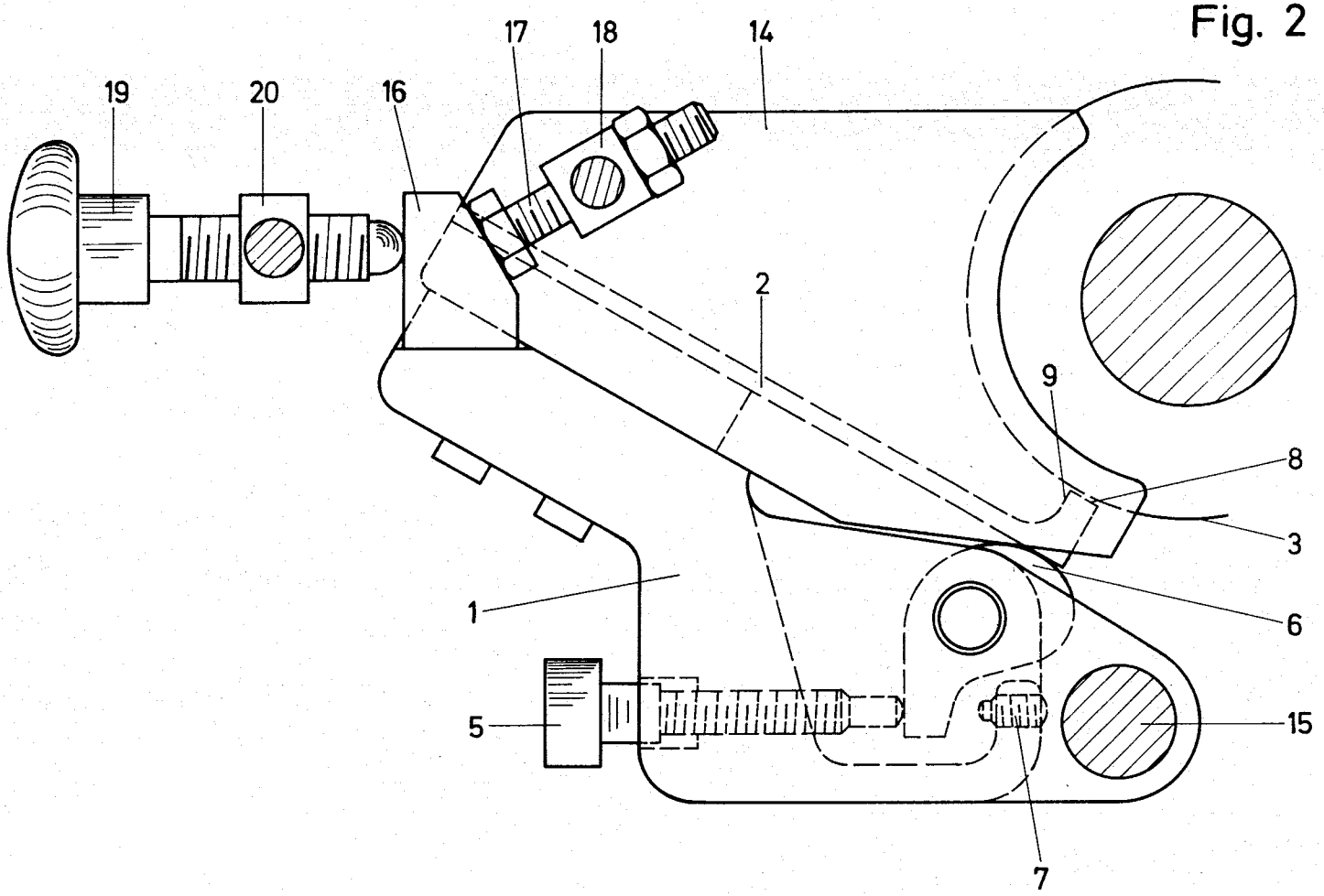

Although the invention is illustrated and described herein as embodied in an ink fountain for printing machine, it is nevertheless not intended to be limited to the details shown, since various modifications and structural changes may be made therein without departing from the spirit of the invention and within the scope and range of equivalents of the claims. The construction and method of operation of the invention, however, together with additional objects and advantages thereof will be best understood from the following decription of specific embodiments when read in connection with the accompanying drawings, in which:

FIG. 1 is a partly diagrammatic cross-sectional view of the ink fountain assembly according to the invention; and FIG. 2 is a front elevational view of FIG. 1. Referring now to the FIGS. of the drawings, there is shown therein an ink fountain 1 disposed in conventional manner between non-illustrated frame supports of a printing machine and carrying an ink knife 2 in an upper region thereof. The ink knife 2 is adjustable relative to an ink ductor or fountain roller 3 so that an ink film of predetermined thickness is transferred to a non-illustrated inking unit of the printing machine. Ink 4 is located between the ink knife 2 and the fountain roller 3.

In the illustrated embodiment of the invention, as shown particularly in FIG. 1, adjusting or set screws 5 are employed as adjusting means for zonewise adjustment of the ink film thickness, the set screws 5 acting upon cam levers 6, to turn the same, the operative zone of a wiper or scraper edge of the ink knife 2 (FIG. 2) being displaced more or less toward the fountain roller 3 during the turning of the cam levers 6. In this regard, the cam levers 6 abut the set screws 5 under the biasing force of torsion springs 25. The maximum adjustment travel of the cam lever 6 is limited and adjustable by means of stop screws 7. Th cam levers 6 support the ink knife 2 at the bend thereof, as shown in FIG. 2, so that the ink knife 2 force-lockingly bears against the cam levers 6. Accordngly, virtually no shifting of the ink knife 2 can be effected by varying hydrodynamic forces.

The ink knife 2 is formed of a member 10 of elastic material, such as thermoplastic material, for example. If necessary, the member 10 is provided with a reinforcement 11 formed of spring steel. The reinforcement 11 may be subdivided zonewise in order to attain an accurate limited adjustment of the ink knife 2. Near the wiper or scraper edge 21 of the ink knife 2, the latter is bent, along the entire length thereof, to form a bent portion 22 extending in direction toward the fountain roller 3. The bent portion 22 has an end face 8 and a scraper or wiper surface 9 separated from one another by the scraper or wiper edge 21 which, as can be seen in FIG. 1, extends perpendicularly to the plane of the FIGURE along the length of the ink knife 2. The end face 8 faces the fountain roller or ink ductor roller 3, a gap 23 being defined therebetween. The wiper surface 9 is located at the inside of the bent knife portion 22 and forms an angle of 90° with the end face 3. The 90° angle can be reduced in order to achieve desirable flow characteristics when the ink is viscous.

The length of the wiper or scraper surface 9 is varied depending upon the consistency of the ink that is used. A length of about 4 mm for the wiper surface 9 is sufficient for the most predominantly used inks. Adjacent to the wiper surface 9, the member 10 of the ink knife 2 is formed with a concavity 24 having a radius of about 6 mm, by means of which, ink that is wiped off the ductor or fountain roller 3 by the wiper edge 21 is returned to the ink fountain 1 without forming obstructing deposits or dams and without forming turbulence or vortices. It is advantageous, in this regard, for the bent knife portion 22 to be disposed at right angles to the ductor or fountain roller 3.

The ink knife 2 is fastened onto an ink knife carrier 12 which is threadedly secured by screws 13 to the ink fountain 1. At both opposite ends thereof, the ink knife 2 is bounded by end plates 14 which are in ink-tight engagement with the end faces of the ductor or fountain roller, as shown more clearly in FIG. 2. The end plates 14 are secured by any suitable means to the ink fountain 1.

The ink fountain 1 is mounted on bearing pins 15 between non-illustrated side frames of a printing machine, respectively, located at opposite sides of the ink fountain 1, and is adjustable into engagement with and away from the fountain or ductor roller 3. In the position wherein it engages the fountain roller 3, the ink fountain 1, through stops 16 carried thereby at both sides thereof, bears against adjusting screws 17, which are mounted by pins 18 on the aforementioned non-illustrated side frames of the printing machine. The stops 16 are set into engagement with the adjusting screws 17 by manually adjustable gripper or knob screws 19, which are also mounted by pins 20 on the non-illustrated side frames of the printing machine.

In the illustrated embodiment of the invention, zonewise adjustment of the ink knife 2 with respect to the ink ductor or fountain roller 3 can be effected by means of the set screws 5 and, in addition, an overall adjustment can be made i.e., the width of the gap 23 can be varied, by means of the adjusting screws 17.

With the aforedescribed angle-shaped or bent construction of the ink knife 2 in accordance with the invention, the flow characteristics of the ink 4 is optimally taken into consideration for all rotary speeds of the ink ductor or fountain roller 3. Furthermore, variations in the dynamic pressure of the ink cannot have a negative or detrimental effect.

It is claimed:

1. Ink fountain for printing machines having a fountain chamber for receiving a supply of ink therein comprising an elongated ink knife forming the base of the fountain chamber, a rotary fountain roller forming a side of the fountain chamber, and means for zonewise adjusting the thickness of a film of ink on said fountain roller, said ink knife having a fixed end and a free end cantilevered therefrom, said free end being yieldable relative to said fixed end, said ink knife having a wiper edge adjacent said fountain roller for wiping ink therefrom, and being bent along the length thereof in direction toward said fountain roller at a location in vicinity of said wiper edge, the bent portion of said ink knife adjacent said wiper edge having an end face opposite to said fountain roller said adjusting means underlying said yieldable free end of said ink knife and coacting therewith for adjusting the spacing of said end face relative to said fountain roller, said bent ink knife also having a wiper surface adjacent said wiper edge and partly defining the interior of said fountain chamber, said wiper surface being disposed at an angle larger than an acute angle to said fountain roller and being streamlined for facilitating a return flow to said interior of said fountain chamber of the ink wiped from said fountain roller.

2. Ink fountain according to claim 1 including means for supporting said ink knife in vicinity of said bend therein.

3. Ink fountain according to claim 1 wherein the bend in said ink knife is a substantially 90° bend, and said wiper surface extends substantially at right angles to said fountain roller.

4. In fountain according to claim 3 wherein said end face of said bent portion forms an acute angle with said wiper surface.

5. Ink fountain according to claim 3 wherein said wiper surface, at a side thereof opposite said wiper edge, merges with a concave channel located at said bend in said ink knife.

6. Ink fountain according to claim 1 wherein said ink knife is formed of elastic material and has a reinforcement formed of spring steel.

7. Ink fountain according to claim 6 wherein said reinforcement is subdivided into separate zones along the length of the knife.

8. Ink fountain according to claim 1 including cam lever means for supporting said ink knife in vicinity of said bend therein, said cam lever means being adjustable for varying zonewise the spacing between said fountain roller and said end face of said bent ink knife portion, set screw means for adjusting said cam lever means, and stop means for limiting maximal adjustment of said set screw means.

9. Ink fountain according to claim 1 including adjusting means for adjusting the position of said ink knife relative to said fountain roller.

10. Ink fountain according to claim 9 wherein said adjusting means comprise adjusting screws.

* * * * *